US009962590B1

(12) United States Patent
McNall

(10) Patent No.: US 9,962,590 B1
(45) Date of Patent: May 8, 2018

(54) BICYCLE ROLLER TRAINER

(71) Applicant: High Point Equipment LLC, Cottonwood Heights, UT (US)

(72) Inventor: Charles W. McNall, Cottonwood Heights, UT (US)

(73) Assignee: High Point Equipment LLC, Cottonwood Heights, UT (US)

( * ) Notice: Subject to any disclaimer, the term of this patent is extended or adjusted under 35 U.S.C. 154(b) by 0 days. days.

(21) Appl. No.: 15/499,614

(22) Filed: Apr. 27, 2017

Related U.S. Application Data

(60) Provisional application No. 62/458,016, filed on Feb. 13, 2017.

(51) Int. Cl.
*A63B 69/16* (2006.01)

(52) U.S. Cl.
CPC ..... *A63B 69/16* (2013.01); *A63B 2069/167* (2013.01)

(58) Field of Classification Search
CPC ..... A63B 69/16–2069/168; A61H 2015/0014
See application file for complete search history.

(56) References Cited

U.S. PATENT DOCUMENTS 463,862 A 11/1891 Guignard
581,835 A 5/1897 Sturgis
3,905,597 A 9/1975 Tabb
4,415,152 A * 11/1983 Smith ..... A63B 22/16 434/247
4,958,832 A * 9/1990 Kim ..... A63B 22/16 482/54
4,982,953 A 1/1991 Makishi
6,436,008 B1 * 8/2002 Skowronski ..... A63B 22/0023 482/51
6,500,098 B1 12/2002 Werner
6,857,992 B1 2/2005 Kolda et al.
7,220,219 B2 5/2007 Papadopoulos et al.
7,520,842 B2 4/2009 Comair et al.
7,942,790 B2 5/2011 Papadopoulos
9,295,894 B2 3/2016 Papadopolous
2004/0198562 A1 10/2004 Greenleaf
2006/0217237 A1 9/2006 Rhodes et al.
2007/0138112 A1 6/2007 Meyer et al.
2014/0296038 A1 10/2014 Colan
2014/0371784 A1 * 12/2014 Kwak ..... A61H 39/04 606/204
2016/0236055 A1 8/2016 Kalogiros et al.

* cited by examiner

*Primary Examiner* — Loan H Thanh
*Assistant Examiner* — Jennifer M Deichl
(74) *Attorney, Agent, or Firm* — Durham Jones & Pinegar; Christopher Wight; Sarah W. Matthews

(57) ABSTRACT

A bicycle roller training device consisting of three rollers for supporting an unsupported or freestanding bicycle using rollers of a novel design. The rollers comprise a barrel, crowned or convex shape with a larger diameter in the center followed by a tapering to a smaller diameter near the sides or ends, optionally having a transitional taper to a larger diameter at the edges. Length of the roller is longer than the diameter of the bicycle tire to be used on the device. The convex center of the roller can either consist of center flat with straight or flat side tapers, constant radius, or convex parabolic shape.

13 Claims, 7 Drawing Sheets

BICYCLE ROLLER TRAINER

TECHNICAL FIELD

The present invention relates to the field of bicycle training devices. More specifically, it relates to bicycle roller trainer devices.

BACKGROUND OF THE INVENTION

A conventional bicycle roller system is a training device for bicyclists typically consisting of three parallel cylindrical rollers supported horizontally in a frame. One roller is positioned below the front wheel of the bicycle and two are positioned below the driven rear wheel. The two rear rollers are placed such that the rear wheel is cradled between them and in contact with both rear rollers at once. The front roller is linked to one of the middle or rear roller, such as with a belt drive, so that when a bicycle is ridden upon the system, the rotation of the middle or rear roller causes the front roller to rotate, thereby resulting in both wheels of the bicycle spinning at the same speed and imparting stability to the bicycle via gyroscopic inertia. Such a bicycle roller system is described in U.S. Pat. No. 581,835 to Sturgis. This inertia allows the bicycle to be maintained in an upright position, but does little to limit lateral movement on the roller system. Minimal deviation of the front wheel from a straight-ahead orientation or a slight shift of the bicycle rider's weight, causes relatively large lateral movement of the bicycle as compared to a bicycle on the ground. This potential for lateral movement and its sensitivity to rider input make rollers an excellent training device to improve bicycle handling skills, but severely limit their use for cardiovascular fitness. The novice and even average rider is constantly at risk of riding off the side of the rollers, as is an accomplished bicyclist should he become fatigued and lose concentration while riding. One solution to the problem of riding off the sides of the rollers is described in U.S. Pat. No. 463,862 to Guignard which employs concave rollers as a means for centering the bicycle. Concave rollers in which the concavity is minimal (i.e., rollers having a shallow curvature), however, offer little aid in keeping the bicycle centered upon the roller. Concave rollers in which the concavity is severe (i.e., rollers having a deep curvature) reduce the skill-training benefit of rollers, while giving the sensation of riding down into a groove in the ground. One effort to combat this sensation was to utilize sloped edges on a normal cylindrical roller as described in U.S. Pat. No. 6,500,098 to Werner. The sloped edges of the rollers however have a tendency to buck or startle a user, causing them to swerve or still ride off of the roller. Because of the above difficulties, bicycle roller use is usually limited to skill training by experienced and accomplished riders.

In addition, the use of a crowned roller on a rear roller of a bicycle roller trainer is also known in the art, as shown in U.S. Patent Publ. No. 2006/0217237 (Paragraph [0046]), which discloses a bicycle roller trainer having flat middle and front rollers, and optionally a convex rear roller. Such crowned rear rollers, however, result in an uncomfortable and destabilizing phenomenon in which movement of a bicycle to the smaller diameter side sections causes the bicycle to move backward, which causes an uncomfortable sensation to the user of backward motion, further potentially disrupting the user's balance on the roller trainer.

Accordingly, there is a need to develop bicycle roller trainers that improves stability, especially for first time and novice users who have not developed the skill of balancing on the roller trainer.

SUMMARY OF INVENTION

It has been determined by the inventors that one or more of the front roller and middle roller having a crowned surface significantly improves stability of a bicycle and rider, compared to traditional flat rollers, as well as compared to a crowned rear roller, especially for novice roller trainer users who have not developed the skill of balancing on a roller trainer. Such improvements in rider and bicycle stability may significantly improve the user friendliness of bicycle roller trainers and may also create incentives for more widespread adoption and use of bicycle roller trainers.

The present invention relates to a bicycle roller trainer comprising a front roller, middle roller and rear roller. In one embodiment, one or more of the middle roller and the front roller is a crowned roller, having a center section, a first side section and a second side section, wherein the diameter of the center section is greater than the diameter of the first side section and the second side section. In some embodiments, the crowned roller is the middle roller. In some embodiments, the crowned roller is the front roller. In some embodiments, the crowned roller is both the front roller and the middle roller.

In another embodiment, the present invention relates to a bicycle roller trainer comprising a middle roller having a center section, a first side section and a second side section, wherein the diameter of the center section is greater than the diameter of the first side section and the second side section. In some embodiments, the center section has a convex surface. In some embodiments, the convex surface has a constant radius of curvature.

In another aspect of the bicycle roller trainer of the present invention, the center section has a flat surface from the center toward the first side section and a flat surface from the center toward the second side section.

The bicycle roller of the present invention may utilize the novel shaped roller described above with a rear roller having a constant diameter.

In another aspect, the bicycle roller trainer of the present invention further includes a first side section having a concave surface and a second side section having a concave surface. In some embodiments, the first side section concave surface and second side section concave surface have a constant radius of curvature. In another embodiment, the first side section and second side section each have an outer edge comprising an upwardly extending portion.

The bicycle roller trainer of the present invention may further comprise a front roller having a shaped profile. For example, the front roller may have a center section, a first side section and second side section, wherein the diameter of the center section is greater than the diameter of the first side section and second side section.

Similarly, the bicycle roller trainer of the present invention may comprise a middle roller having a convex surface extending from a first end to a second end. In some embodiments, the convex surface has a constant radius of curvature.

In yet another aspect, one or more roller of the bicycle roller trainer of the present invention may comprise a plurality of independent adjacent segments that can be reversibly joined together to form a customizable shaped roller having a crowned profile.

BRIEF DESCRIPTION OF DRAWINGS

The novel features believed characteristic of the invention are set forth in the appended claims. The invention itself, however, as well as a preferred mode of use and objects and advantages thereof, will best be understood by reference to the following detailed description of an illustrative embodiment when read in conjunction with the accompanying drawings, wherein:

DETAILED DESCRIPTION OF THE INVENTION

Figure 1:
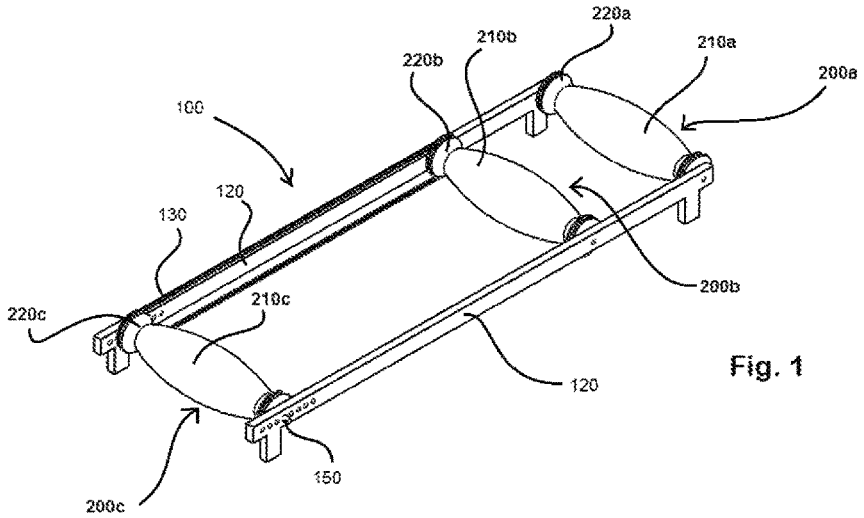
FIG. 1 is a perspective view of a bicycle trainer made in accordance with the present invention.

This present invention relates to a bicycle roller training device of the three-roller type—having a front roller, middle roller and rear roller—using rollers of a novel crowned design. In one aspect, the present invention relates to a bicycle roller trainer comprising a middle roller having a center section, a first side section and a second side section, wherein the diameter of the center section is greater than the diameter of the first side section and the second side section. As described herein, the above configuration is generally referred to as a "crowned" roller, in which the center section of the roller has a larger diameter than the side sections. Variations on the crowned roller include, for example, a convex roller and a conical roller.

In one aspect, the present invention relates to a bicycle roller trainer comprising a front roller, middle roller and rear roller. In one embodiment, one or more of the middle roller and the front roller is a crowned roller, having a center section, a first side section and a second side section, wherein the diameter of the center section is greater than the diameter of the first side section and the second side section. In some embodiments, the crowned roller is the middle roller. In some embodiments, the crowned roller is the front roller. In some embodiments, the crowned roller is both the front roller and the middle roller.

The device configuration can consist of a single novel crowned roller on the front roller, middle roller, or both the front and middle roller. The novel crowned roller may also be used on a plurality of rollers, including the rear roller. The novel roller comprises a middle section of a convex, barrel, crowned or rounded shape followed by a reduction in diameter towards the edges of the roller in a transitional portion. In some embodiments, the novel roller has a second transitional portion increasing in diameter at the ends or sides of the roller. The front roller center diameter can be the same diameter as the rear rollers, a larger diameter or a smaller diameter allowing different wheel speeds and roller feel. The transitional portions preferably have a curvilinear profile and an identical or symmetrical profile at both ends or sides of a roller. The preferred shape of the center portion of the novel roller is that of a standard constant radius of curvature; however, the improved rollers of the present invention could have a flat section in the center of the roller before starting its taper. Alternatively, the crowned rollers of the present invention could have a convex parabolic profile design.

In some embodiments, the middle portion of the roller has a crowned or convex shape, which has been found to yield multiple significant benefits. First the crowned slope imparts a centralizing force that is due to an increase in contact area of the tire on the inclined side of the roller causing the tire to climb the roller as rotation occurs. The crowned shape also retards lateral movement as the wheel encounters resistance when trying to steer toward the center of the roller over a traditional flat or concave roller. A larger front diameter also has the added benefit of causing the front wheel to spin faster with less input from the rear wheel aiding the user in stabilization. Location of the shaped rollers also plays a role in the stability of the system. If the rear most roller is convex in shape the user has a sinking feeling when riding away from the center portion that is uneasy to the rider.

In contrast, convex rear rollers steer the front of the bicycle by torque on the bicycle about the contact point on the center roller. This creates an effect causing the bicycle to have less stable motion at the front or steering end. Locating the crowned or convex rollers in the front or center, or alternatively in both the front and the center, of the trainer aids in centering the bicycle on the rollers during use. A shaped center roller alone aids in torque steering the bicycle by utilizing the point of contact on the rear roller as a pivot point and pushing the front of the bicycle towards center. This effect would not occur if both of the rear rollers (i.e., the middle roller and the rear roller) are shaped as they would both cause positional motion on the rotating wheel. Utilizing a shaped roller in front can also aid in centering the bicycle as it does not have another roller to torque against and the front tire rides up toward the largest radius as previously described.

Accordingly, the bicycle training rollers of the present invention were found to significantly improve stability and enjoyment, especially among novice users who were more sensitive to unstable conditions and whose performance was enhanced by the improved stability of the bicycle roller trainer. Although measurement of "stability" and "enjoyment" may be statistically challenging, the inventors have conducted preliminary experiments supporting the anecdotal experience of users that the claimed invention results in a superior and improved stability and enjoyment, especially for novice users who are unfamiliar or inexperienced on roller trainers.

The present invention relates generally to a bicycle roller trainer having shaped middle roller and/or a shaped front roller. In the embodiments of the present invention specifically described herein, the shaped middle and front rollers have a center section, a first side section and a second side section, wherein the diameter of the center section is greater than the diameter of the first side section and the second side section.

As used herein, the term "center section" refers to the middle area of a bicycle trainer roller encompassing the center of the roller, extending to the right and to the left of the center of the roller. As used herein the term "side section" refers to the area of a bicycle trainer roller extending from the center section to the sides near the edges of the roller, extending from the edge a distance toward the middle section of the roller. It is understood that the center section and side sections refer to areas of the roller relative to each other and that these sections need not be defined by any particular distance or dimension. Thus, the center section may encompass an area that is relatively narrow or wide relative to the area of the side sections. However, in order to provide a smooth transition for riders moving between the center section and side section, it is contemplated that the transition zones will be gradual and smooth.

In another aspect, the center section has a convex surface. In some embodiments, the present invention relates to a bicycle roller trainer having a middle roller and/or front roller having a convex surface. In some embodiments, the convex surface has a constant radius of curvature.

In one aspect the present invention comprises a bicycle roller trainer comprising a middle roller having a convex surface extending from a first end to a second end. In some embodiments, the convex surface has a constant radius of curvature.

As used herein, the terms "convex," "concave," and "flat" are used in reference to the curvature or shape of the top surface of the roller where a bicycle tire contacts the roller, extending along the width of the roller from one side to the opposite side along the axis of rotation of the roller. Thus, the term "convex" means that the surface where the tire contacts the roller is curved or rounded outward, such that the diameter of the roller at the center of the middle section is greater than the diameter of the roller to the sides of the center or at the ends. Similarly, the term "concave" means the surface where the tire contacts the roller is curved or rounded inward, such that the diameter of the roller at the center of the middle section is less than the diameter of the roller to the sides of the center or at each side. The term "flat," means that all or a portion of the surface where the tire contacts the roller is flat, extending from the center to each side. Thus, where the diameter of the center section is greater than the diameter of the first side section and second side section, the roller may in some embodiments have a "flat" surface over a portion of the roller where the tire contacts the roller, such that the entire roller surface has a conical shape extending from the center of the roller outwardly toward the sides. The term "flat," as used in reference to the entire roller, means that the surface where the tire contacts the roller has a constant diameter (i.e., the roller has a standard cylindrical shape).

Thus, the term "convex middle section" means the top surface of the middle section of the roller where a bicycle tire contacts the roller has a convex curvature extending along its axis of rotation, such that the center surface of the roller has a higher elevation (and the center has a greater diameter) than the surface of the roller to the immediate left and right of the center of the roller. Similarly, the term "convex first side section" and "convex second side section" mean the top surface of the side sections of the roller near the ends of the roller (to the right and left of the middle section of the roller) have a concave curvature extending along the axis of rotation of the roller, such that the side sections of the roller have a portion that is lower in elevation (and have a smaller diameter) than the surface of the roller to the immediate left and right.

Accordingly, in some embodiments, the center section has a flat surface from the center toward the first side section and a flat surface from the center toward the second side section.

In some embodiments of the present invention, the rear roller has a constant diameter, while the middle and front roller comprise a crowned shape, as described above.

In yet other embodiments, the first side section of a roller has a concave surface and the second or opposite side section of the roller has a concave surface. Desirably, the concave surface of the sides or ends of the roller smoothly transition to the crowned or convex center portion of the roller, such that there are no significant abrupt transitions that would cause a rider to loose balance or momentum. In some embodiments, the concave surface at each end or side of the roller may have a constant radius of curvature. In other embodiments, the curvature of the concave surface at each end or side of the roller may have a parabolic radius of curvature, or some other radius of curvature that is not constant or fixed.

In another aspect, the bicycle roller trainer of the present invention has a first side section and a second side section each of which have an outer edge comprising an upwardly extending portion. This configuration aids in keeping the bicycle from inadvertently rolling off of the bicycle roller trainer apparatus by provide sidewalls to the roller that impede the movement of a bicycle tire off of the bicycle roller.

In another aspect, the bicycle roller trainer of the present invention further comprises a front roller having a center section, a first side section and second side section, wherein the diameter of the center section is greater than the diameter of the first side section and second side section. It has been discovered that a shaped front roller may also be advantageous in keeping the bicycle centered on the roller trainer device, especially when used in combination with a crowned middle roller.

The present invention may be illustrated by reference to the drawings, FIGS. 1-13, which illustrate various embodiments of the present invention. Not all embodiments covered by the claims are necessarily illustrated in the figures. The figures are intended merely to illustrate particular embodiments that may be covered by the claims.

Figure 5:
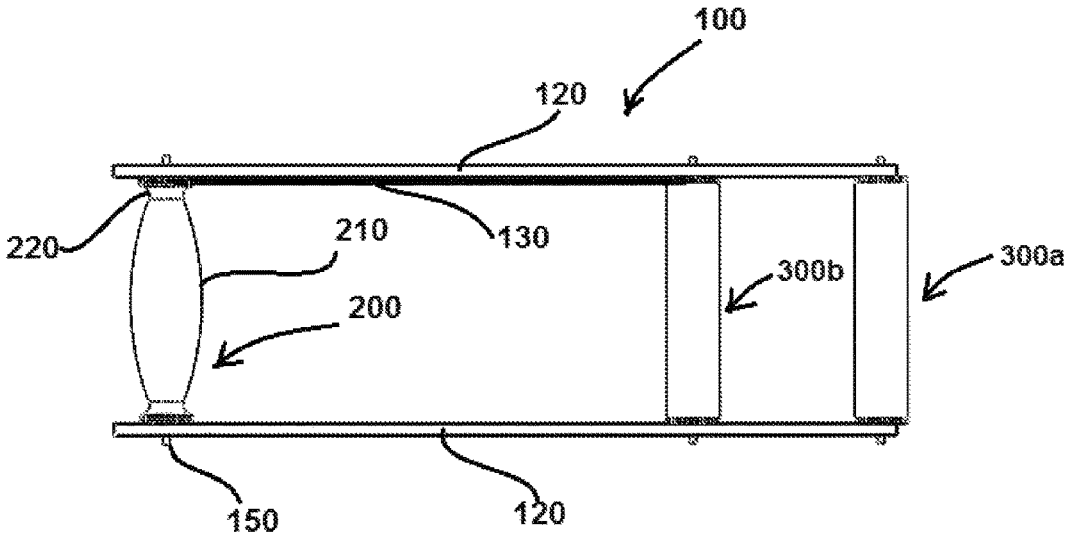
FIG. 5 is a top plan view of the bicycle trainer of the present invention.
Figure 6:
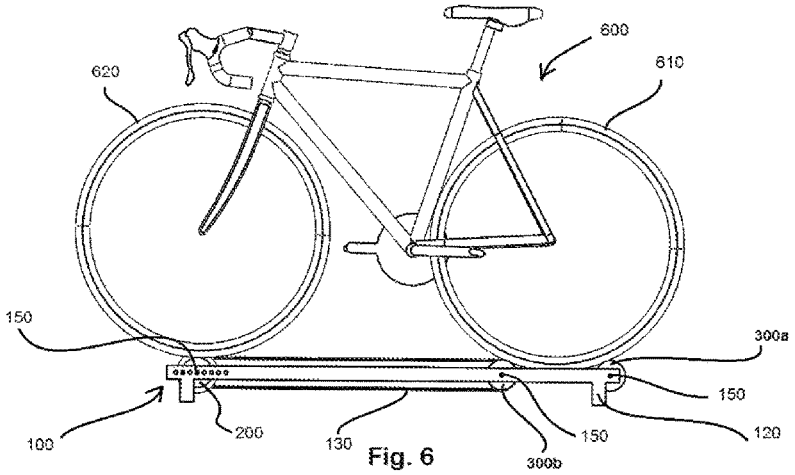
FIG. 6 is a cutaway side elevation view of the bicycle trainer of the present invention.

As shown in FIGS. 1, 5, and 6, a roller-type stationary bicycle trainer 100 may include two frame members 120 joined by axial members 150 supporting a series of rollers 200*a* (rear roller), 200*b* (middle roller) and 200*c* (front roller), each having a crowned center section 210*a*, 210*b* and 210*c*, as shown specifically in FIG. 1. As shown in FIG. 1, rollers are connected via a belt 130 in order to provide motion from the rear wheel 610 of a bicycle 600 to the front wheel of the bicycle 620, in which the rotation of the middle roller 210*b* transfers rotational movement to the front roller 210*c* via the belt 130. FIG. 1 also shows a concave side or end sections 220*a*, 220*b* and 220*c* (also present but not seen on the opposite side of the roller). FIG. 1 further shows adjustment points 150 which allow for changing the position of the front roller 210*c* to accommodate bicycles having different distances or spans between the front and rear tires.

Figure 2:
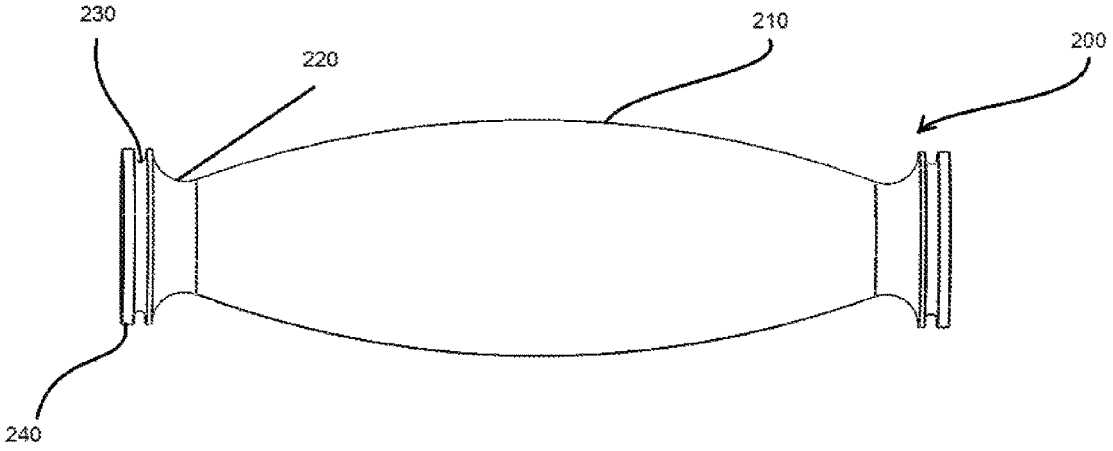
FIG. 2 is a front elevation view of a roller of the bicycle trainer of the present invention.

One configuration of a roller 200 is shown in FIG. 2, which consists of a novel convex or arched central section 210 and a transitional concave area 220 leading up to the end diameter 240. The edges of the roller 200 can optionally have an integrated mechanism for connection of a belt 230 or other motion transfer mechanism.

Figure 3:
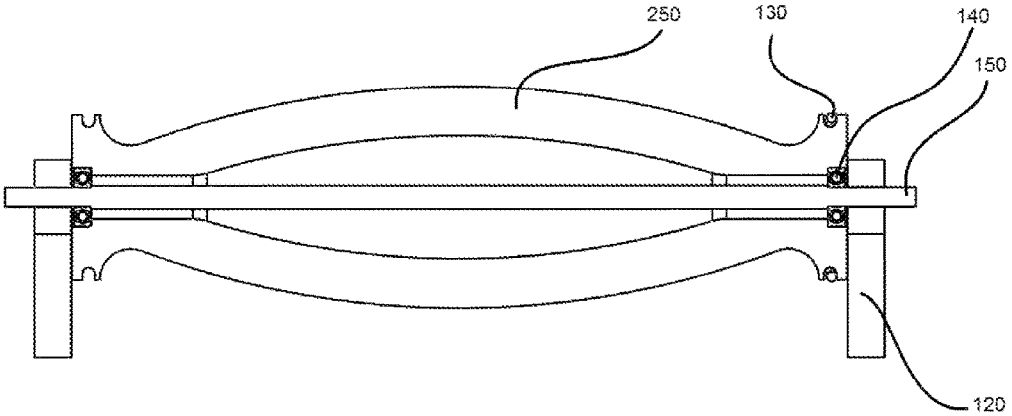
FIG. 3 is a cross-sectional elevation view of a roller of the bicycle trainer of the present invention having a single material for the roller body.

FIG. 3 shows a cross section of one embodiment of the roller 200, which consists of bearings 140 mounted on an axial shaft 150 and in support of the roller as a single body 250.

Figure 4:
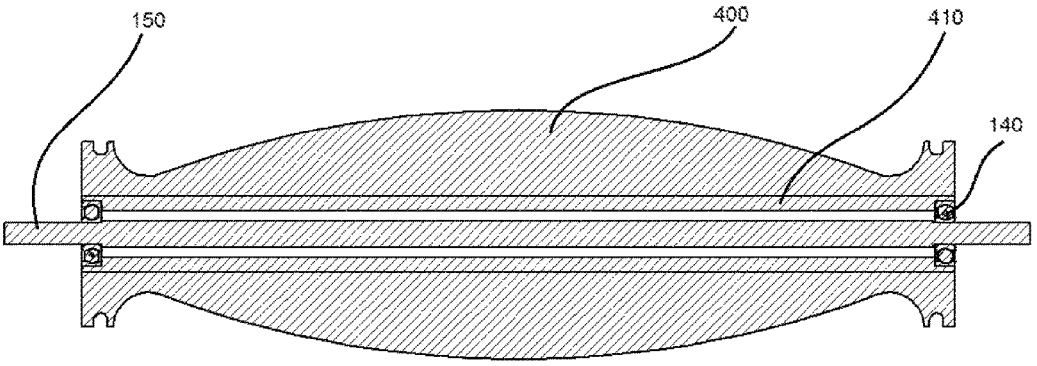
FIG. 4 is a cross-sectional elevation view of a roller of the bicycle trainer of the present invention having a supporting member and secondary body as outer shaped member.

FIG. 4 is another embodiment of the roller 400 in which the roller has a separate supporting member 410 in which the bearing 140 is mounted. The supporting member 410 allows for the outer roller material to act as a compression member as opposed to a structural member.

Figure 11:
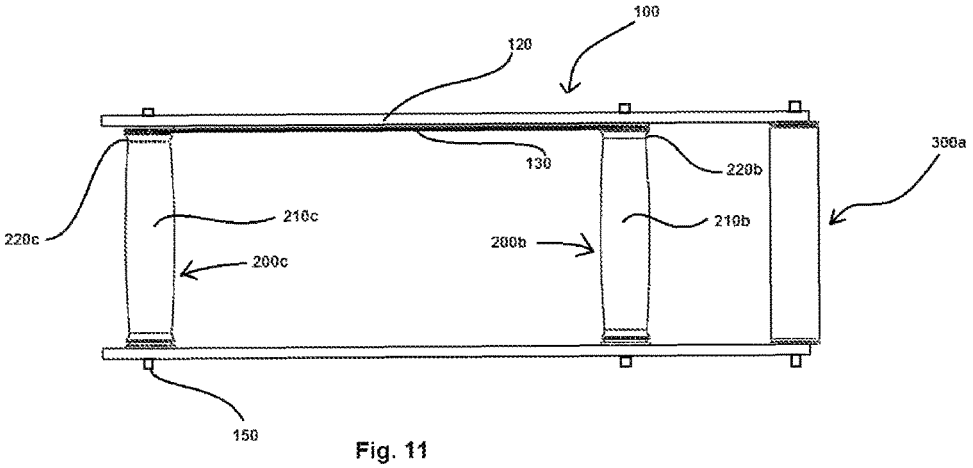
FIG. 11 is a top view of a bicycle roller trainer having a flat rear roller, convex middle roller, and convex front roller.
Figure 12:
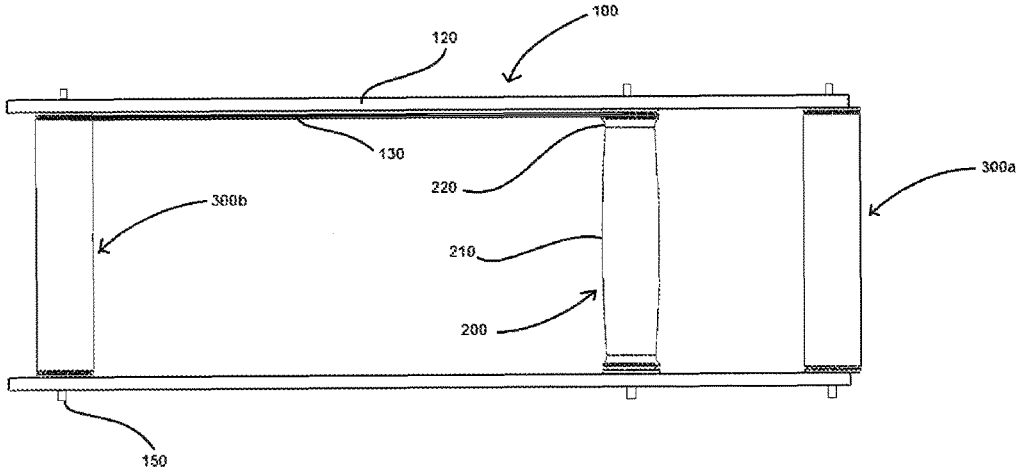
FIG. 12 is a top view of a bicycle roller trainer having a flat rear roller, convex middle roller, and flat front roller.

As shown in FIG. 5, the roller 100 is not limited to having the same roller 200 in all locations. Alternate rollers 300*a* and 300*b* can be used for the rear roller or middle roller or any variation of novel rollers 200 and alternate rollers 300*a* and 300*b*. FIGS. 11 and 12 show alternative configurations. FIG. 11, for example, shows a bicycle roller trainer having a crowned or convex surface on both the middle and front rollers, with the rear roller having a standard cylindrical roller having a flat profile. FIG. 12 shows a bicycle roller trainer having a crowned or convext surface on the middle roller, with the rear and front rollers having a standard cylindrical roller having a flat profile.

FIG. 6 shows a typical bicycle 600 with the front wheel 620 in contact with the front roller 200 and the rear wheel 610 in contact with each of the middle roller rollers 300*a* and 300*b*.

Figure 7:
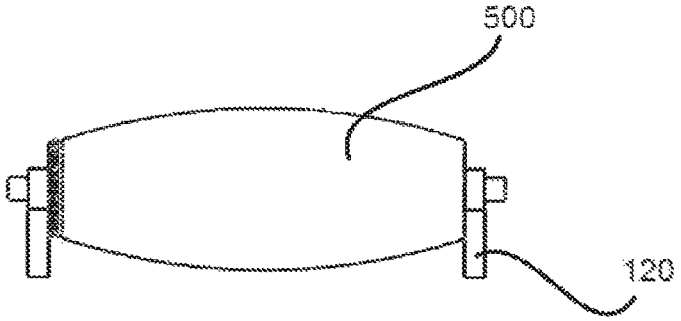
FIG. 7 is a front elevation view of a roller of the bicycle trainer of the present invention having no larger diameter transitions at roller ends.

FIG. 7 depicts an alternate embodiment having a roller design 500 that does not contain a raised end radius.

Figure 8:
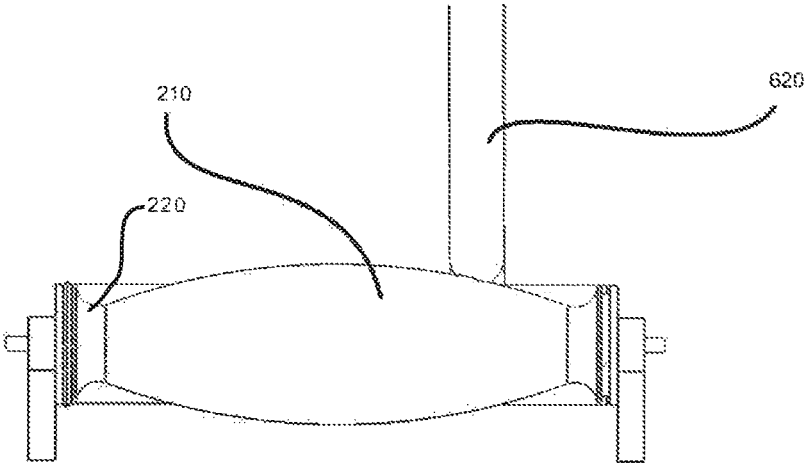
FIG. 8 is a front elevation view of a roller of the bicycle trainer of the present invention with a tire resting on the roller offset from the center location.

FIG. 8 shows the curved surface of the roller 210 in relation to the front wheel 620 tire of the bicycle 600. The convex curved surface 210 creates a preferential contact area with the front tire on the bicycle 620 that causes the tire to climb toward the peak of the roller keeping the bicycle centered during riding. The curved roller surface 210 also reduces the overcorrection of steer as the tire is trying to turn up an upward curved surface further aiding in the stability of the rider. The transitional portion of the roller 220 and the curved surface 210 also create a trough for the wheel of the bicycle 620 to rest in if the user steers away from the center of the roller, preventing the wheel 620 from rolling off of the roller 200 or training device 100 completely.

Figure 9:
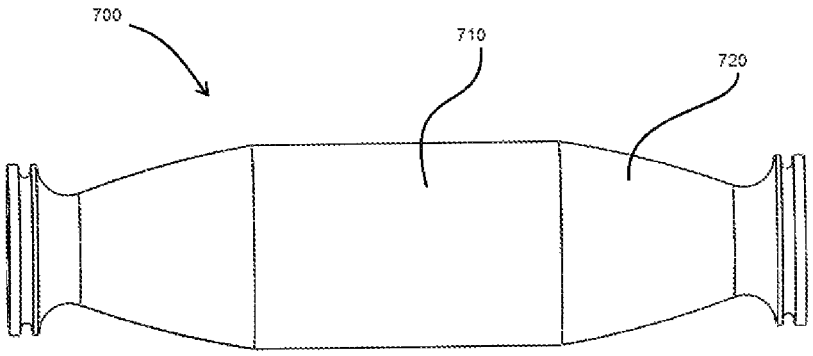
FIG. 9 is a front elevation view of a roller of the bicycle trainer of the present invention having a central flat portion.

As shown in FIG. 9, another alternate roller design 700 can contain a central cylindrical section 710 that is crowned in the center portion, with the crown having a flat surface profile, as well as tapering transition portion 720 to a smaller diameter.

Figure 10:
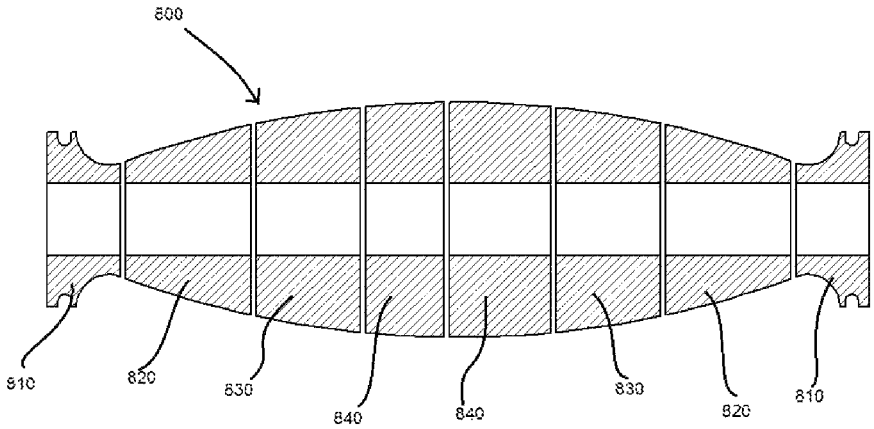
FIG. 10 is a cross-sectional elevation view of a roller of the bicycle trainer of the present invention having a roller of multiple adjacent pieces.

FIG. 10 depicts an alternate design of the roller 800 consisting of a plurality of adjacent stacked independent sections 810, 820, 830, and 840 that can be joined together to provide an end user with a customizable shaped roller of different difficulties for training purposes. For example, while the convex shape of the center section may provide greater initial stability for novice users, the crowned center section, or a portion of the crowned center section, may be replaced with a flat section having a constant diameter, to thereby provide more difficult balance training for a more experienced user. Similarly, the center section may be replaced with multiple crowned sections interspersed with multiple concave sections, to simulate uneven terrain and train a user to develop compensatory balance techniques.

FIG. 11 shows one embodiment of the present invention in which the bicycle roller trainer 100 has a crowned convex middle roller 210*b*, a crowned convex front roller 210*c*, each having a concave sides 200*b* on each side of the roller. Rear roller 300*a* has a standard flat profile surface.

FIG. 12 show an embodiment in which the bicycle roller trainer 100 has a crowned convex middle roller 210, with standard flat profile front and rear rollers 300*b* and 300*a*.

In accordance with the disclosure herein, the bicycle trainer 100 comprises a novel roller design 200 which is of a crowned design, such as a convex or barrel shape, or a conical shape.

Figure 13:
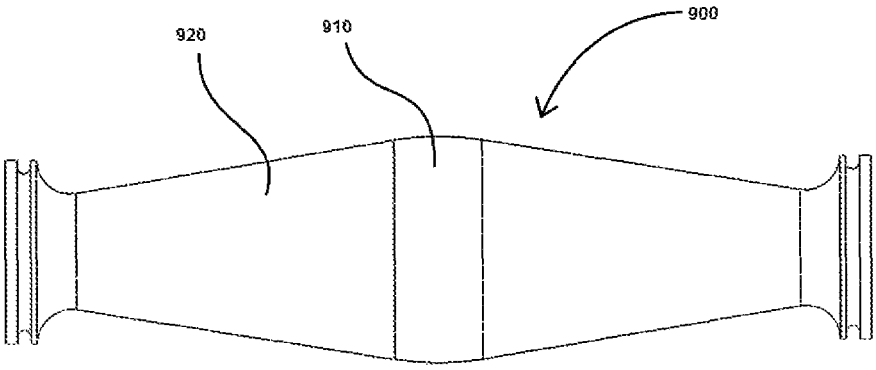
FIG. 13 is a side view of a conical shaped roller.

FIG. 13 depicts an alternate embodiment having a roller design 900 having a crowned center portion 910 with flat surfaces 920 on each side of the center portion 910, wherein the flat portions define a conical shaped surface or profile.

Stability and User Preference Testing

User testing was performed with two versions of a roller trainer—Trainer A having a convex middle roller and flat rear and front rollers (as shown in FIG. 11) and Trainer B being a configuration having a convex rear roller with flat middle and front rollers. Users were selected who had no prior experience using bicycle roller trainers in order to evaluate first-time user experience with stability and personal preference. The users were asked to try a standard non-shaped roller trainer as a baseline of value 5 and to rate the two configurations on stability and enjoyment or personal preference. No indication of a preferred embodiment was given to the users. Each user tried each version at least twice.

The results of testing of this embodiment of the invention by five users are listed in Table A below.

TABLE A

| Testing | User | Stability Roller A | Enjoyment Roller A | Stability Roller B | Enjoyment Roller B | Preference |
|---|---|---|---|---|---|---|
| | 1 | 7 | 6 | 6 | 7 | A |
| | 2 | 7.25 | 8 | 6 | 7 | A |
| | 3 | 8 | 7 | 7 | 7 | A |
| | 5 | 7 | 7 | 6 | 6 | A |
| Average | | 7.45 | 7 | 6.4 | 6.8 | |

The average stability rating of configuration A was higher than configuration B. Similarly, the average enjoyment rating of configuration A was higher than configuration B. Thus, the outcome of the study showed that novice users who had never previously used a bicycle roller trainer found that configuration A, having a convex middle roller, was both more stable and more enjoyable than configuration B, having convex rear roller.

The invention is useful in the manufacture of bicycle training apparatus that permits a user to train in an indoor environment while maintaining a natural and realistic feel with improved safety. The description of the embodiments of the present invention is given above for the understanding of the present invention. It will be understood that the invention is not limited to the particular embodiments described herein, but is capable of various modifications, rearrangements, and substitutions which will now become apparent to those skilled in the art without departing from the scope of the invention. For example, although a bicycle roller trainer has been illustrated in the drawings with rollers of the same size and width, the invention is capable of utilizing combinations of rollers of various lengths and widths, having various middle and end diameters and various rates of diameter increase in the transitional portions of the rollers.

Therefore it is intended that the following claims cover all such modifications and changes as fall within the true spirit and scope of the invention.

The invention claimed is:

1. A bicycle roller trainer comprising a plurality of rollers comprising a front roller, middle roller and rear roller, each rotationally smooth and configured for direct contact with a bicycle tire, wherein one or more of the middle roller and the front roller is a crowned roller, having a center section, a first side section and a second side section, wherein the diameter of the center section is greater than the diameter of the first side section and the second side section to form a laterally smooth convex surface extending from the first side section to the second side section.

2. The bicycle roller trainer according to claim 1, wherein the crowned roller has a center section having a laterally smooth convex surface.

3. The bicycle roller trainer according to claim 1, wherein the center section has a flat surface from the center toward the first side section and a flat surface from the center toward the second side section.

4. The bicycle roller trainer according to claim 1, wherein the rear roller has a constant diameter.

5. The bicycle roller trainer of claim 1, wherein the first side section has a concave surface and the second side section has a concave surface.

6. The bicycle roller trainer according to claim 5, wherein the first side section concave surface and second side section concave surface have a constant radius of curvature.

7. The bicycle roller trainer according to claim 5, wherein the first side section and second side section each have an outer edge comprising an upwardly extending portion.

8. The bicycle roller trainer according to claim 1, wherein the front roller comprises a center section, a first side section and second side section, wherein the diameter of the center section is greater than the diameter of the first side section and second side section forming a laterally smooth convex cross section.

9. The bicycle roller trainer according to claim 1, wherein the crowned roller is the middle roller.

10. The bicycle roller trainer according to claim 1, wherein the crowned roller is the front roller.

11. The bicycle roller trainer according to claim 1, wherein the crowned roller comprises both the middle roller and front roller.

12. The bicycle roller trainer according to claim 1, wherein one or more of the front roller, middle roller and rear roller comprises a plurality of independent adjacent segments that can be reversibly joined together to form a customizable shaped roller having a crowned laterally smooth convex profile.

13. A bicycle roller trainer comprising a plurality of rollers, one of the plurality of rollers comprising a crowned middle tubular-shaped roller having a center section, a first side section and a second side section, wherein the diameter of the center section is greater than the diameter of the first side section and the second side section to form a convex surface extending from a first end to a second end, and the plurality of rollers being rotationally smooth and configured for direct contact with a bicycle tire.

* * * * *